US009728154B2

(12) United States Patent
Kim et al.

(10) Patent No.: US 9,728,154 B2
(45) Date of Patent: Aug. 8, 2017

(54) DISPLAY APPARATUS

(71) Applicant: SAMSUNG DISPLAY CO., LTD., Yongin, Gyeonggi-Do (KR)

(72) Inventors: Heendol Kim, Yongin (KR); Jai-Hyun Koh, Hwaseong-si (KR); Jinpil Kim, Suwon-si (KR); Seokyun Son, Yongin-si (KR); Ik Soo Lee, Seoul (KR)

(73) Assignee: Samsung Display Co., Ltd., Yongin-si (KR)

( * ) Notice: Subject to any disclaimer, the term of this patent is extended or adjusted under 35 U.S.C. 154(b) by 33 days.

(21) Appl. No.: 14/802,953

(22) Filed: Jul. 17, 2015

(65) Prior Publication Data

US 2016/0042711 A1 Feb. 11, 2016

(30) Foreign Application Priority Data

Aug. 11, 2014 (KR) ..... 10-2014-0103803

(51) Int. Cl.

| | |
|---|---|
| ***G09G 3/36*** | (2006.01) |
| ***G09G 3/20*** | (2006.01) |
| ***G09G 5/18*** | (2006.01) |
| ***G09G 3/34*** | (2006.01) |

(52) U.S. Cl.

CPC ..... *G09G 3/3688* (2013.01); *G09G 3/2003* (2013.01); *G09G 3/2074* (2013.01); *G09G 3/3406* (2013.01); *G09G 3/3426* (2013.01); *G09G 3/3607* (2013.01); *G09G 3/3648* (2013.01); *G09G 5/18* (2013.01); *G09G 2300/0426* (2013.01); *G09G 2300/0452* (2013.01); *G09G 2310/0264* (2013.01); *G09G 2310/08* (2013.01); *G09G 2320/0233* (2013.01);

(Continued)

(58) Field of Classification Search

CPC ..... G09G 3/36

See application file for complete search history.

(56) References Cited

U.S. PATENT DOCUMENTS

| | | | | |
|---|---|---|---|---|
| 7,123,277 | B2 | 10/2006 | Brown Elliott et al. | |
| 2011/0057950 | A1* | 3/2011 | Kim | G09G 5/02 345/602 |
| 2011/0149166 | A1* | 6/2011 | Botzas | H04N 5/202 348/649 |

FOREIGN PATENT DOCUMENTS

| | | | |
|---|---|---|---|
| KR | 10-2012-0128091 | A | 11/2012 |
| KR | 10-2013-0073667 | A | 7/2013 |
| WO | WO 2008/100826 | A1 | 8/2008 |

* cited by examiner

*Primary Examiner* — Joseph Haley

(74) *Attorney, Agent, or Firm* — Lewis Roca Rothgerber Christie LLP

(57) ABSTRACT

Disclosed is a display apparatus including: a display panel including a plurality of pixels each for displaying an image corresponding to a data signal; and a timing controller configured to receive an image signals and to convert the image signal into the data signal to be supplied to the display panel, wherein the timing controller is further configured to convert the image signal into an intermediate data signal and to generate the data signal, which corresponds to a k-th pixel, on a basis of intermediate data signals corresponding to a (k−1)-th pixel, the k-th pixel and a (k+1)-th pixel of the plurality of pixels, wherein the data signal corresponding to a first pixel of the plurality of pixels includes first and second color signals and the data signal corresponding to a second pixel of the plurality of pixels includes third and fourth color signals.

14 Claims, 8 Drawing Sheets

(52) U.S. Cl.
CPC ..... *G09G 2320/0242* (2013.01); *G09G 2320/0673* (2013.01); *G09G 2340/0457* (2013.01)

DISPLAY APPARATUS

CROSS-REFERENCE TO RELATED APPLICATION

This application claims priority to and the benefit of Korean Patent Application No. 10-2014-0103803 filed Aug. 11, 2014, in the Korean Intellectual Property Office, the entire contents of which are hereby incorporated by reference.

BACKGROUND

1. Field

Embodiments of the inventive concept described herein relate to a display apparatus.

2. Description of the Related Art

Display apparatuses generally use the three primary colors of red (R), green (G) and blue (B) to display diverse colors. For such functionality, a display panel of the display apparatus includes sub-pixels, Rx, Gx, and Bx, corresponding respectively to red, green, and blue. In recent years, it has been proposed to employ white sub-pixels to enhance a luminance level of an image. For example, a pentile mode that replaces two conventional pixels including six sub-pixels (i.e. Rx, Gx, Bx, Rx, Gx, and Bx) with two pixels including four sub-pixels (i.e. Rx, Gx, Bx, and Wx) has been proposed.

A display apparatus adopting the pentile mode includes a rendering module in order to compensate degradation of resolution due to a decrease of the number of sub-pixels. The rendering module functions to transform red, green, and blue image signals, which are applied from an external source, into red, green, blue, and white data signals, and adjust luminance of a backlight unit, thus enhancing luminance of an image thereof.

SUMMARY

One aspect of embodiments of the inventive concept is directed to provide a display apparatus capable of reducing or minimizing its memory size utilized for an operation of a rendering module thereof.

In an embodiment, a display apparatus may include: a display panel including a plurality of pixels each for displaying an image corresponding to a data signal; and a timing controller configured to receive an image signal and to convert the image signal into the data signal to be supplied to the display panel. The timing controller may further be configured to convert the image signal into an intermediate data signal and to generate the data signal, which corresponds to a k-th pixel, on the basis of intermediate data signals corresponding to a (k−1)-th pixel, the k-th pixel and a (k+1)-th pixel of the plurality of pixels, wherein the data signal corresponding to a first pixel of the plurality of pixels includes first and second color signals, and wherein the data signal corresponding to a second pixel of the plurality of pixels may include third and fourth color signals.

In some embodiments, the image signals corresponding respectively to the plurality of pixels may include the first and second color signals, and the intermediate data signals corresponding respectively to the plurality of pixels include the first, second, third, and fourth color signals.

In some embodiments, the first pixel may be adjacent to the second pixel.

In some embodiments, the first pixel may include first and second sub-pixels corresponding respectively to the first and second color signals, and the second pixel may include third and fourth sub-pixels corresponding respectively to the third and fourth color signals.

In some embodiments, the display apparatus may further include: a gate driver configured to sequentially select the plurality of pixels of the display panel; a data driver configured to supply an operating voltage, which corresponds to the data signal, to the selected pixel; and a backlight unit configured to supply light to the display panel.

In some embodiments, the timing controller may include: a rendering module configured to convert the image signal into the intermediate data signal and to generate the data signal on the basis of the intermediate data signal; a backlight controller configured to output a backlight control signal for operating the backlight unit on the basis of the intermediate data signal; and a control signal generator configured to output a first control signal for operating the data driver and a second control signal for operating the gate driver in response to a control signal supplied from an external source.

In some embodiments, the rendering module may include: an input gamma adjuster configured to adjust gamma characteristics of the image signal; a mapping unit configured to map an output signal of the input gamma adjuster into the intermediate data signal; a renderer configured to calculate the intermediate data signal and a resampling filter factor to output a rendering signal; and an output gamma adjuster configured to adjust the gamma characteristics of the rendering signal to output the data signal.

In some embodiments, the renderer may be configured to output the rendering signal by calculating the data signals corresponding respectively to the (k−1)-th, k-th, and (k+1)-th pixels, and the resampling filter factors corresponding respectively to the (k−1)-th, k-th, and (k+1)-th pixels.

In some embodiments, a ratio of the resampling filter factors corresponding respectively to the (k−1)-th, k-th, and (k+1)-th pixels may be 0.24:0.5:0.25.

In some embodiments, the renderer may include: a resampling filter configured to supply the resampling filter factor; and an arithmetic unit configured to calculate the intermediate data signal and the resampling filter factor.

In some embodiments, the renderer may include: a first filter configured to supply a first filter factor; a luminance calculator configured to calculate luminance of the intermediate data signal; a first arithmetic unit configured to calculate the first filter factor and an output of the luminance calculator; a second filter configured to supply a second filter factor; a second arithmetic unit configured to calculate the intermediate data signal and the second filter factor; a third filter configured to supply a third filter factor; a third arithmetic unit configured to calculate the intermediate data signal and the third filter factor; a first multiplexer configured to output one of output signals from the second and third arithmetic units in response to a first selection signal; a fourth arithmetic unit configured to calculate output signals of the first and second arithmetic units; and a second multiplexer configured to output one of output signals from the fourth arithmetic unit and the first multiplexer in response to a second selection signal.

In some embodiments, the first filter may be a sharpening filter, the second filter may be a resampling filter, and the third filter may be a box filter.

BRIEF DESCRIPTION OF THE DRAWINGS

The above and other aspects and features will become apparent from the following description with reference to the following figures, wherein like reference numerals refer to like parts throughout the various figures unless otherwise specified, and wherein.

DETAILED DESCRIPTION

Figure 1:
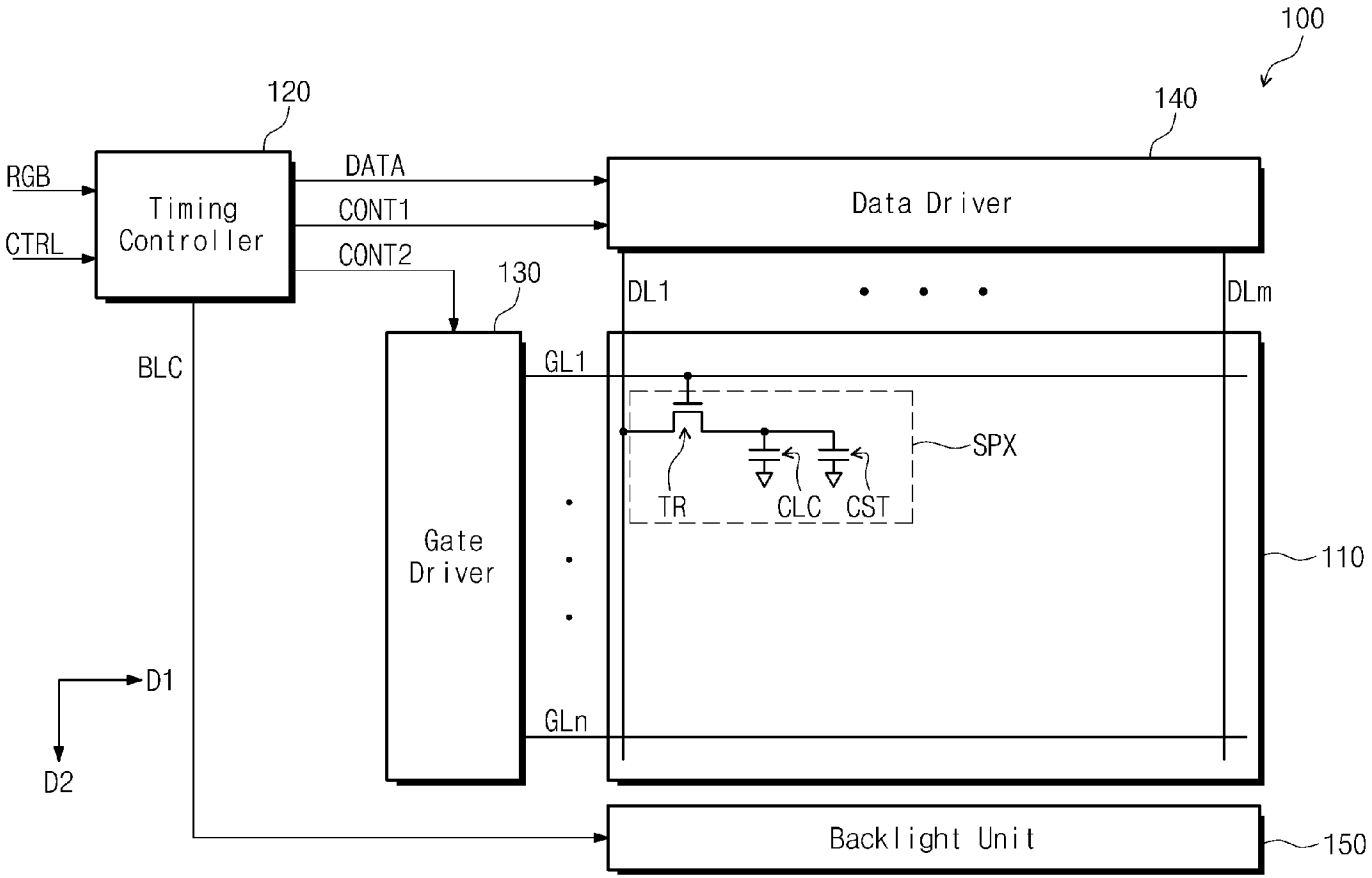
FIG. 1 is a block diagram illustrating a display apparatus according to embodiments of the inventive concept.

Embodiments will be described in detail with reference to the accompanying drawings. The inventive concept, however, may be embodied in various different forms, and should not be construed as being limited only to the illustrated embodiments. Rather, these embodiments are provided as examples so that this disclosure will be thorough and complete, and will fully convey the concept of the inventive concept to those skilled in the art. Accordingly, known processes, elements, and techniques are not described with respect to some of the embodiments of the inventive concept. Unless otherwise noted, like reference numerals denote like elements or components throughout the attached drawings and written description, and thus descriptions will not be repeated. In the drawings, the sizes and relative sizes of layers and regions may be exaggerated for clarity.

It will be understood that, although the terms "first", "second", "third", etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the inventive concept.

Spatially relative terms, such as "beneath", "below", "lower", "under", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements or components described as "below" or "beneath" or "under" other elements or components or features would then be oriented "above" the other elements or components or features. Thus, the exemplary terms "below" and "under" can encompass both an orientation of above and below. The device may be otherwise oriented (rotated 90 degrees or at other orientations) and the spatially relative descriptors used herein interpreted accordingly. In addition, it will also be understood that when a layer is referred to as being "between" two layers, it can be the only layer between the two layers, or one or more intervening layers may also be present.

The terminology used herein is for the purpose of describing particular embodiments only and is not intended to be limiting of the inventive concept. As used herein, the singular forms "a" and "an" are intended to include the plurality forms as well, unless the context clearly indicates otherwise. It will be further understood that the terms "include," "comprises," "comprising," "includes," "including," and "include," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Also, the term "exemplary" is intended to refer to an example or illustration.

It will be understood that when an element or layer is referred to as being "on," "connected to," "coupled to," "connected with," "coupled with," or "adjacent to" another element or layer, it can be "directly on," "directly connected to," "directly coupled to," "directly connected with," "directly coupled with," or "directly adjacent to" the other element or layer, or intervening elements or layers may be present. When an element is referred to as being "directly on," "directly connected to," "directly coupled to," "directly connected with," "directly coupled with," or "immediately adjacent to" another element or layer, there are no intervening elements, components or layers present.

Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and/or the present specification and will not be interpreted in an idealized or overly formal sense unless expressly so defined herein.

As used herein, the terms "use," "using," and "used" may be considered synonymous with the terms "utilize," "utilizing," and "utilized," respectively.

The timing controller and/or any other relevant devices or components according to embodiments of the present invention described herein may be implemented utilizing any suitable hardware, firmware (e.g. an application-specific integrated circuit), software, or a suitable combination of software, firmware, and hardware. For example, the various components of the timing controller may be formed on one integrated circuit (IC) chip or on separate IC chips. Further, the various components of the timing controller may be implemented on a flexible printed circuit film, a tape carrier package (TCP), a printed circuit board (PCB), or formed on a same substrate as one or more circuits and/or devices of the display apparatus. Further, the various components of the timing controller may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

Although this invention has been described in certain specific embodiments, those skilled in the art will have no difficulty devising variations to the described embodiment, which in no way depart from the scope and spirit of the present invention. Furthermore, to those skilled in the various arts, the invention itself herein will suggest solutions to other tasks and adaptations for other applications. It is the applicant's intention to cover by claims all such uses of the invention and those changes and modifications which could be made to the embodiments of the invention herein chosen for the purpose of disclosure without departing from the spirit and scope of the invention. Thus, the present embodiments of the invention should be considered in all respects as illustrative and not restrictive, the scope of the invention to be indicated by the appended claims and their equivalents rather than the foregoing description.

Now hereinafter will be described exemplary embodiments of the inventive concept in conjunction with accompanying drawings.

FIG. 1 is a block diagram illustrating a display apparatus according to embodiments of the inventive concept.

Referring to FIG. 1, the display apparatus 100 includes a display panel 110, a timing controller 120, a gate driver 130, a data driver 140, and a backlight unit 150.

The display panel 110 functions to display images. Although this embodiment is given with the display panel 110 as a kind of liquid crystal display panel as an example, the display panel 110 may be another kind utilizing the backlight unit 150.

The display panel 110 includes a plurality of gate lines GL1~GLn extending along a first direction D1, a plurality of data lines DL1~DLm extending along a second direction D2, and a plurality of sub-pixels SPX arranged in crossing regions at which the plurality of gate and data lines GL1~GLn and DL1~DLm are crossing each other. The plurality of data and gate lines DL1~DLm and GL1~GLn are electrically isolated from each other. Each sub-pixel SPX includes a thin film transistor TR, a liquid crystal capacitor CLC, and a storage capacitor CST.

The plurality of sub-pixels SPX are in the same structure. Therefore, one of the sub-pixels will be representatively described without respective explanations about all of them. The thin film transistor of the sub-pixel SPX includes a gate electrode connected to, for example, the first gate line GL1 of the plurality of gate lines GL1~GLn, a source electrode connected to, for example, the first data line DL1 of the plurality of data lines DL1~DLm, and a drain electrode connected to the liquid crystal capacitor CLC and the storage capacitor CST. Ends of the liquid crystal capacitor CLC and the storage capacitor CST are connected to the drain electrode of the thin film transistor TR in parallel. The other ends of the liquid crystal capacitor CLC and the storage capacitor CST may be connected with a common voltage.

The timing controller 120 receives an image signal RGB and a control signals CTRL from an external source. The control signal CTRL may include, for example, a vertical sync signal, a horizontal sync signal, a main clock signal, a data enable signal, etc. The timing controller 120 converts the image signal RGB into a data signal DATA that is processed to be suitable for an operating condition thereof. The timing controller 120 outputs first and second control signals CONT1 and CONT2 on the basis of the control signal CTRL. The timing controller 120 applies the data signal DATA and the first control signal CONT1 to the data driver 140, and applies the second control signal CONT2 to the gate driver 130. The first control signal CONT1 may include a horizontal sync start signal, a clock signal and the line latch signal, while the second control signal CONT2 may include a vertical sync start signal, an output enable signal and a gate pulse signal. The timing controller 120 is capable of providing the data signal DATA with diverse forms in accordance with display frequencies and arrangement patterns of the sub-pixels SPX of the display panel 110. Additionally, the timing controller outputs a backlight control signal BLC for controlling the backlight unit 150.

The gate driver 130 activates the gate lines GL1~GLn in response to the second control signal CONT2 which is supplied from the timing controller 120. The gate driver 130 may include a gate driving integrated circuit (IC). The gate driver 130 may be formed in a region (e.g., a predetermined region) of the display panel 110 by using a semiconductor oxide, an amorphous semiconductor, a polycrystalline semiconductor, etc.

The data driver 140 supplies an operating voltage to the data lines DL1~DLm in response to the data signal DATA and the first control signal CONT1 which are applied from the timing controller 120.

The backlight unit 150 is arranged opposite to the sub-pixels SPX under the display panel 110. The backlight unit 150 operates in response to the backlight control signal BLC which is applied from the timing controller 120.

Figure 2:
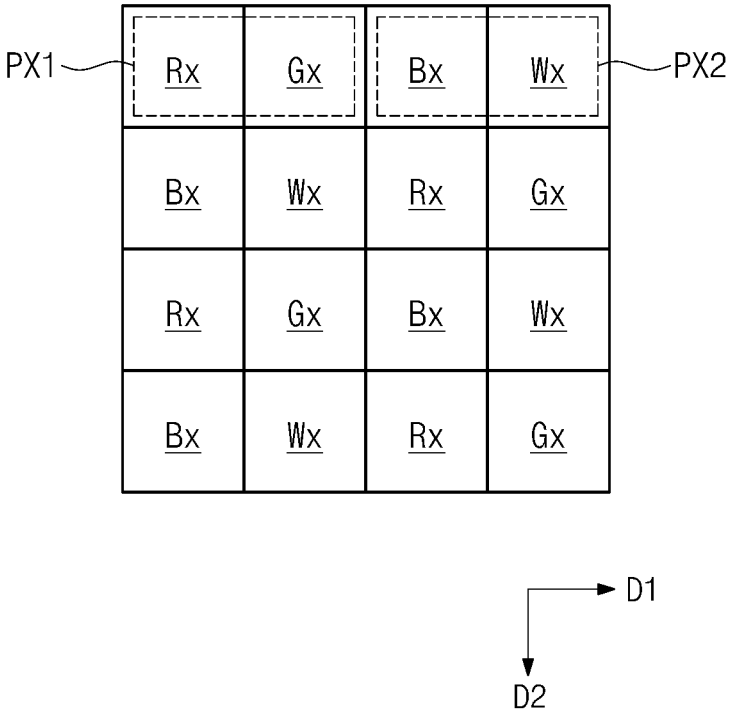
FIG. 2 illustrates an example arrangement of pixels included in the display panel shown in FIG. 1.

FIG. 2 illustrates an example arrangement of pixels included in the display panel shown in FIG. 1.

Referring to FIG. 2, the display panel 110 includes first and second pixels PX1 and PX2. The first pixel PX1 includes first and second sub-pixels Rx and Gx. The second pixel PX2 includes third and fourth sub-pixels Bx and Wx. The first and second pixels PX1 and PX2 are sequentially arranged by turns in the first and second directions D1 and D2.

In this specification, the display panel 110 is described as adopting RGBW, whereas the inventive concept may be embodied by another display panel operating with multiple primary colors (e.g. RGBY, RGBC, CNYW, etc.).

Figure 3:
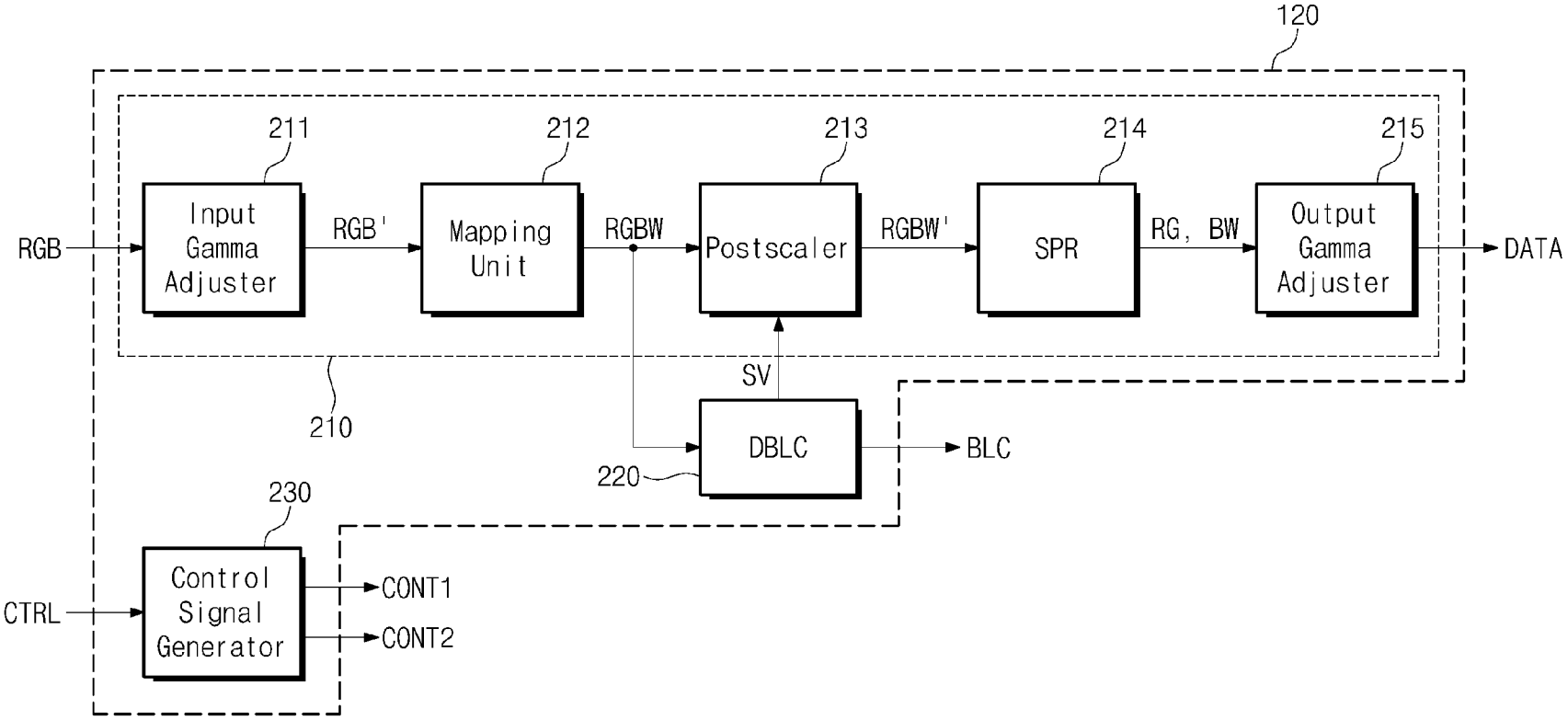
FIG. 3 is a block diagram illustrating a configuration of the timing controller shown in FIG. 1.

FIG. 3 is a block diagram illustrating a configuration of the timing controller 120 shown in FIG. 1.

Referring to FIG. 3, the timing controller 120 includes a rendering module 210, a backlight controller (DBLC) 220, and a control signal generator 230. The rendering module 210 includes an input gamma adjuster 211, a mapping unit 212, a postscaler 213, a sub-pixel renderer (SPR) 214, and an output gamma adjuster.

The input gamma adjuster 211 receives the image signal RGB. The input gamma adjuster 211 outputs a gamma data signal RGB' which is linearized to make the gamma characteristics proportional to luminance. The gamma data signal RGB' includes first, second and third color signals. In some embodiments, each of the first to third color signals includes a red signal R, a green signal G, and a blue signal B. The mapping unit 212 functions to map the gamma data signal RGB' into a first intermediate data signal RGBW which includes a white signal W as well as the red signal R, the green signal G, and the blue signal B.

The backlight controller 220 creates a histogram corresponding to the image characteristics of the first intermediate data signal RGBW, and to generates the backlight control signal BLC with reference to the histogram. The backlight control signal BLC is applied to the backlight unit 150 shown in FIG. 1. Additionally, the backlight controller 220 applies a scaling signal SV, which corresponds to the backlight control signal BLC, to the postscaler 213.

The postscaler 213 utilizes the scaling signal SV to output a second intermediate signal RGBW' for which the first intermediate data signal RGBW is adjusted in luminance.

The sub-pixel renderer 214 outputs rendering signals RG and BW in response to the second intermediate data signal RGBW'. The output gamma adjuster 215 outputs the data signal DATA which is non-linearized by adapting the inverse gamma function to the rendering signals RG and BW. The data signal DATA is supplied to the data driver 140 shown in FIG. 1.

The control signal generator 230 responds to the external control signal CTRL to output the first control signal CONT1 for controlling the data driver 140 (shown in FIG. 1), and the second control signal CONT1 for controlling the gate driver 130 (shown in FIG. 1).

Figure 4A:
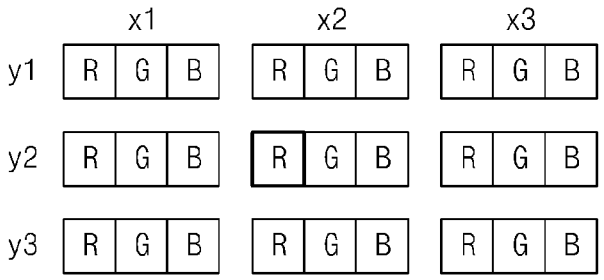
FIGS. 4A, 4B, and 4C illustrate an example procedure of mapping and rendering with the mapping unit and the sub-pixel render.
Figure 4B:
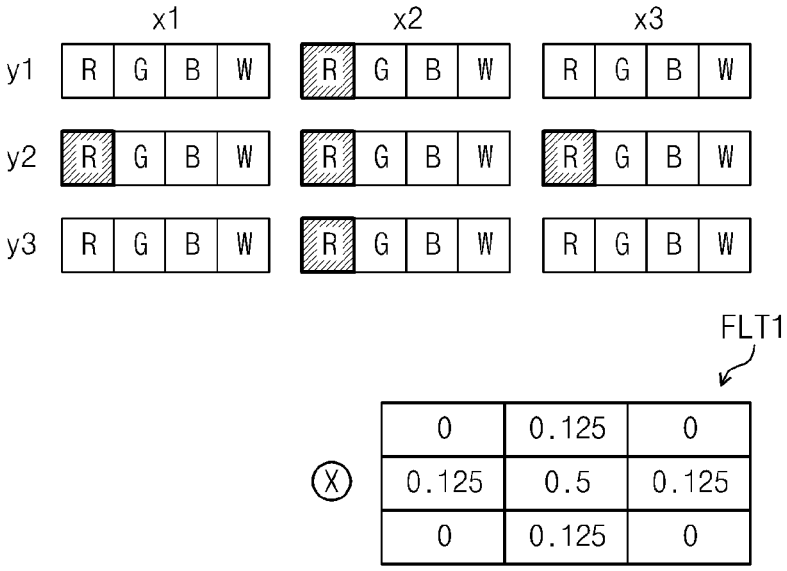
Figure 4C:
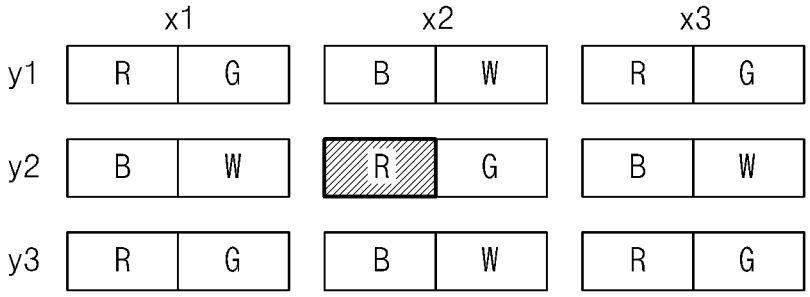

FIGS. 4A, 4B, and 4C illustrate an example procedure of mapping and rendering with the mapping unit 212 and the sub-pixel renderer 214. In FIG. 4A, the pixels of the 3-pixel system are indicated by the X-Y coordinates. FIGS. 4B and 4C are illustrated to match the X-Y coordinates to the 4-pixel system and the pentile system, respectively. Hereupon, as the sub-pixel renderer 214 employs a diamond filter which uses nine pixels, FIG. 4A shows nine pixels, for example.

Referring to FIGS. 3, 4A, and 4B, the mapping unit 212 operates to map the red, green, and blue signals R, G, and B, which are respectively supplied to the pixels, into the red, green, blue, and white signals R, G, B, and W.

Referring to FIGS. 3, 4B and 4C, the first intermediate data signal RDBW output from the mapping unit 212, i.e. the red, green, blue, and white signals R, G, B, and W, is converted into the second intermediate data signal RGBW' according to the scaling signal SV by the postscaler 213. The sub-pixel renderer 214 may conduct a rendering operation for the second intermediate data signal RGBW' by means of the diamond filter. For instance, the sub-pixel renderer 214 may pass a reference red signal R, which is located in a pixel of a coordinate [x2, y2], and eight red signals R, which are contiguous to the reference red signal R, through the diamond filter FTL1, thus generating a red signal R in correspondence with the red sub-pixel of the pentile system.

As illustrated in FIG. 4B, the diamond filter FTL1 is storing scale factors respective to the nine designated areas. The sub-pixel renderer 214 is capable of multiplying the nine red signals respectively by the scale factors of their correspondent positions and calculating a sum of the multiplied values as a rendering value of the reference red signal R. During this, a sum of the scale factors attached to the nine designated positions is set to be 1. Similarly, it is also possible to operate the green, blue, and white signals in such a rendering process. However, the rendering process with the diamond filter FTL1 may utilize a memory for storing color signals of at least three rows, requiring a complex arithmetic logic circuit therefor.

Figure 5:
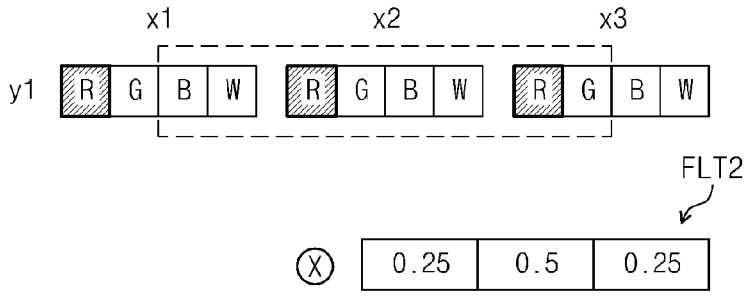
FIG. 5 illustrates an example rendering operation of the sub-pixel renderer shown in FIG. 3.

FIG. 5 illustrates an example rendering operation of the sub-pixel renderer 214 shown in FIG. 3.

Referring to FIGS. 3 and 5, the sub-pixel renderer 214 may operate to pass a reference red signal R, which is located in a pixel of a coordinate point (e.g., a predetermined coordinate point), and two red signals R, which are adjacent to the reference red signal R, through a resampling filter FTL2, thus generating a red signal R of the pentile system. For example, the sub-pixel renderer 214 passes a reference red signal R in a pixel of a coordinate [x2, y1], a red signal in a pixel of a coordinate [x1, y1], and a red signal R in a pixel of a coordinate [x3, y1] through the resampling filter FTL2, then generating a red signal R corresponding to the red sub-pixel of the pentile system.

In other words, for a red signal R of a k-th pixel, after red signals R of (k−1)-th and (k+1)-th pixels pass the resampling filter FTL2, a red signal R corresponding to the red sub-pixel of the pentile system is generated (k is a positive integer). In some embodiments, a factor ratio of the resampling filter FTL2 may set to be 0.25:0.5:0.25.

Figure 6:
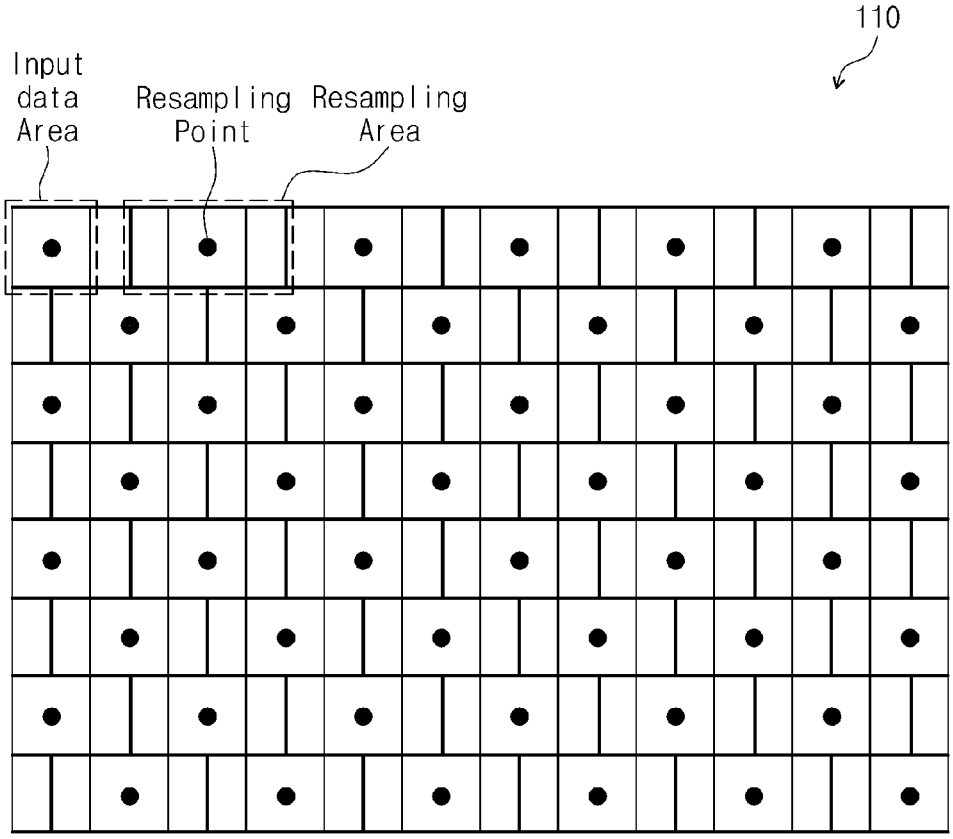
FIG. 6 illustrates an example rendering operation of the sub-pixel rendering module of FIG. 3 on the display panel shown in FIG. 1.

FIG. 6 illustrates an example rendering operation of the sub-pixel renderer 214 of FIG. 3 on the display panel shown in FIG. 1.

Referring to FIG. 6, the image signal RGB supplied from an external source corresponds to the pixels of the display panel 110. In other words, an input data area corresponds to each pixel. The sub-pixel renderer 214 performs the rendering operation for a resampling area including partial regions of pixels located left and right on a pixel corresponding to a resampling point. The resampling area includes a pixel corresponding to the resampling point, and parts of left and right pixels adjacent to the pixel of the resampling point. For example, assuming that the resampling area includes 50% of the left pixel adjacent to the resampling point, 100% of the pixel corresponding to the resampling point, and 50% of the right pixel adjacent to the resampling point, occupation rates of the pixels within the resampling areas are 25%, 50% and 25%, respectively. Accordingly, the factor ratio becomes 0.25:0.5:0.25.

Figure 7:
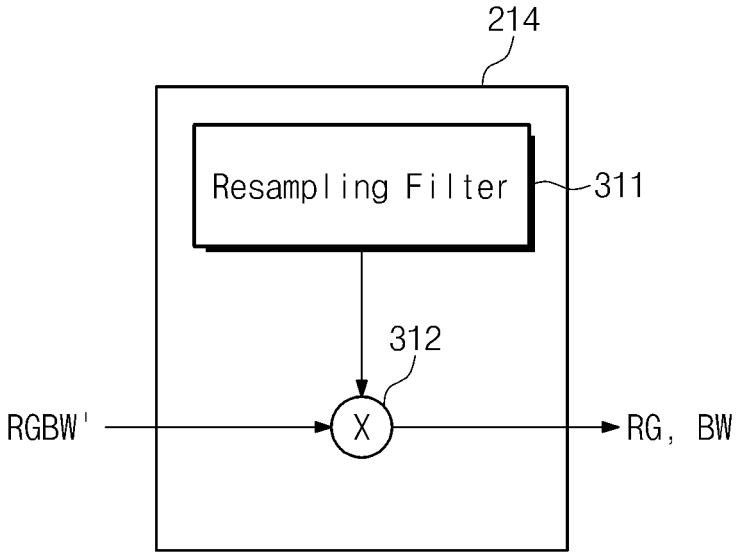
FIG. 7 illustrates an example configuration of the sub-pixel renderer shown in FIG. 3.

FIG. 7 illustrates am example configuration of the sub-pixel renderer 214 shown in FIG. 3.

Referring to FIG. 7, the sub-pixel renderer 214 includes a resampling filter 311 and an arithmetic unit 312. The resampling filter 311 may be the resampling filter FTL2, a filter factor of which is supplied to the arithmetic unit 312.

The arithmetic unit 312 calculates the second intermediate data signal RGBW', which is supplied from the postscaler 213 (shown in FIG. 3), and the filter factor, which is supplied from the resampling filter 311, to output the rendering signals RG and BW.

Figure 8:
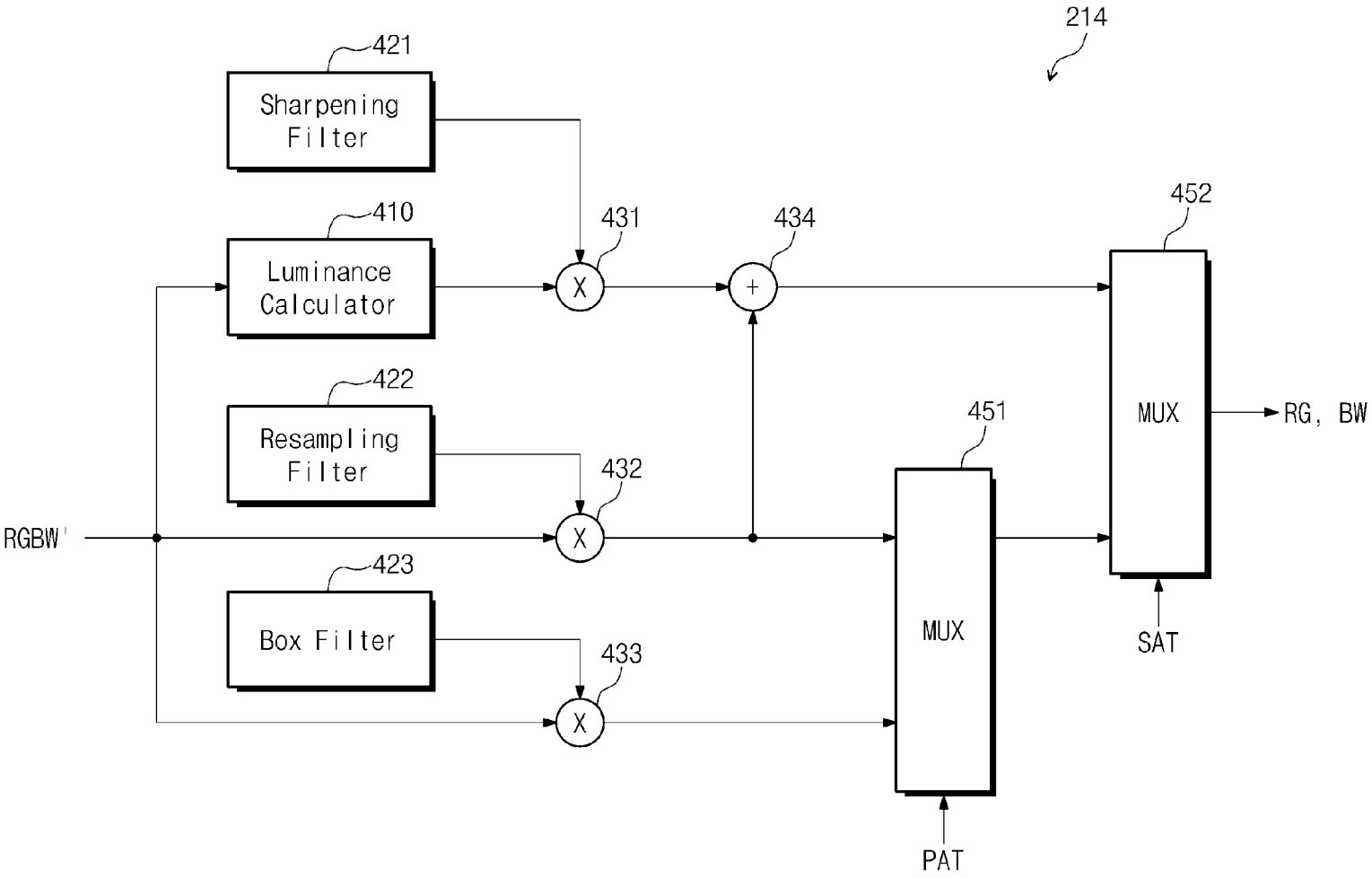
FIG. 8 illustrates an example configuration of the sub-pixel renderer shown in FIG. 3.

FIG. 8 illustrates an example configuration of the sub-pixel renderer 214 shown in FIG. 3.

Referring to FIG. 8, the sub-pixel renderer 214 includes a luminance calculator 410, a sharpening filter 421, a resampling filter 422, a box filter 423, arithmetic units 431~434, and multiplexers 451 and 452.

The second intermediate data signal RGBW' output from the postscaler 213 shown in FIG. 3 is supplied to the luminance calculator 410 and the arithmetic units 432 and 433. The luminance calculator 410 functions to calculate luminance of the second intermediate data signal RGBW'. The sharpening filter 421 is prepared to make bright pixels brighter and dark pixels darker, thus reinforcing images to be more vivid. For example, a sharpening filter factor of the sharpening filter 421 is set to be [−0.25, 0.5, −0.25]. The arithmetic unit 431 multiplies a luminance value, which is output from the luminance calculator 410, by the filter factor of the sharpening filter 421.

The resampling filter 422 is characterized as the resampling filter 311 aforementioned in conjunction with FIG. 7. For example, a filter factor of the resampling filter 422 is set to be [0.25, 0.5, 0.25]. The arithmetic unit 432 multiplies the second intermediate data signal RGBW' by the filter factor of the resampling filter 422.

The arithmetic unit 434 sums up outputs of the arithmetic units 431 and 432.

The box filter 423 is provided to display slanting lines, dots, etc. For example, a box filter factor of the box filter 423 is set to be [0, 0.5, 0.5]. The arithmetic unit 433 multiplies the second intermediate data signal RGBW' by the box filter factor of the box filter 423.

The multiplexer 451 alternatively outputs one of the output signals of the arithmetic units 432 and 433 in response to a first selection signal PAT. The multiplexer 452 outputs the rendering signals RG and BW from one of the output signals of the arithmetic unit 434 and the multiplexer 451 in response to a second selection signal SAT.

The first selection signal PAT is a flag signal for indicating whether one or more of the color signals corresponding to the three pixels included in the rendering area have been saturated. For example, the first selection signal PAT may be given by Equation 1 as follows.

$$SINV=min_RGB/max_RGB \qquad \text{Equation 1}$$

In Equation 1, the items min_RGB and max_RGB are the minimum and the maximum color signals, respectively, of the three pixels included in the rendering area.

From Equation 1, when SINV<(STH−1) and max_RGB<SBTH for values (e.g., predetermined values) of STH and SBTH, the second selection signal PAT is set to be '1'.

The first selection signal PAT is set to be '1' when an image displayed by the color signals corresponding to the three pixels included in the rendering area is displaying a line. For example, it is assumed that the first selection signal PAT is denoted by '1' when the color signals corresponding to the three pixels included in the rendering area are larger than a reference value (e.g., a predetermined reference value), or denoted by '0' when the color signals are smaller than the reference value. If a pattern corresponding to the color signals corresponding to the three pixels included in the rendering area is one of [1,0,0], [0,1,0], [0,0,1], [0,1,1], [1,0,0] and [1,1,0], the first selection signal PAT is set to be '1'.

When the first selection signal PAT is '0', the multiplexer 451 selects the output signal of the arithmetic unit 432. When the first selection signal PAT is '1', the multiplexer 451 selects the output signal of the arithmetic unit 433. When the second selection signal SAT is '0', the multiplexer 452 selects an output signal of the arithmetic unit 434. When the second selection signal SAT is '1', the multiplexer 452 selects an output signal of the multiplexer 451.

The sub-pixel renderer 214 shown in FIG. 8 further includes the sharpening filter 421 and the box filter 423 as well as the resampling filter 422. Therefore, it is more advantageous to improving image quality, relative to a renderer that simply employs the resampling filter 422.

As described above, the display apparatus with the aforementioned configuration is useful for reducing or minimizing the number of pixels included in the resampling area. Therefore, it is possible to reduce a memory size utilized for the operation of the rendering module.

While the inventive concept has been described with reference to exemplary embodiments, it will be apparent to those skilled in the art that various changes and modifications may be made without departing from the spirit and scope of the present invention as defined by the following claims and their equivalents. Therefore, it should be understood that the above embodiments are not limiting, but illustrative.

What is claimed is:

1. A display apparatus comprising:

a display panel comprising:

a plurality of pixels each for displaying an image corresponding to a data signal; and a timing controller configured to receive an image signal and to convert the image signal into the data signal to be supplied to the display panel, wherein the timing controller is further configured to convert the image signal into an intermediate data signal and to generate the data signal, which corresponds to a k-th pixel, on a basis of intermediate data signals corresponding to a (k−1)-th pixel, the k-th pixel, and a (k+1)-th pixel of the plurality of pixels, wherein the data signal corresponding to a first pixel of the plurality of pixels comprises first and second color signals, wherein the data signal corresponding to a second pixel of the plurality of pixels comprises third and fourth color signals, wherein the timing controller comprises:

a first filter configured to supply a first filter factor;

a second filter configured to supply a second filter factor; and a third filter configured to supply a third filter factor, wherein the timing controller is further configured to calculate the intermediate data signal, the first filter factor and the second filter factor and to generate the data signal based on the calculation result when the intermediate data signals corresponds to the (k−1)-th pixel, the k-th pixel and the (k+1)-th pixel are not saturated, and wherein the timing controller is further configured to calculate the intermediate data signal and the third filter factor and to generate the data signal based on the calculation result when the intermediate data signals corresponds to the (k−1)-th pixel, the k-th pixel and the (k+1)-th pixel have a line image.

2. The display apparatus according to claim 1, wherein the image signals corresponding respectively to the plurality of pixels comprise the first and second color signals, and wherein the intermediate data signals corresponding respectively to the plurality of pixels comprise the first, second, third, and fourth color signals.

3. The display apparatus according to claim 1, wherein the first pixel is adjacent to the second pixel.

4. The display apparatus according to claim 3, wherein the first pixel comprises first and second sub-pixels corresponding respectively to the first and second color signals, and wherein the second pixel comprises third and fourth sub-pixels corresponding respectively to the third and fourth color signals.

5. The display apparatus according to claim 1, further comprising:

a gate driver configured to sequentially select the plurality of pixels of the display panel;

a data driver configured to supply an operating voltage, which corresponds to the data signal, to the selected pixel; and a backlight unit configured to supply light to the display panel.

6. The display apparatus according to claim 5, wherein the timing controller comprises:

a rendering module configured to convert the image signal into the intermediate data signal and to generate the data signal on the basis of the intermediate data signal;

a backlight controller configured to output a backlight control signal for operating the backlight unit on the basis of the intermediate data signal; and a control signal generator configured to output:

a first control signal for operating the data driver, and a second control signal for operating the gate driver in response to a control signal supplied from an external source.

7. The display apparatus according to claim 6, wherein the rendering module comprises:

an input gamma adjuster configured to adjust gamma characteristics of the image signal;

a mapping unit configured to map an output signal of the input gamma adjuster into the intermediate data signal;

a renderer configured to calculate the intermediate data signal and a resampling filter factor to output a rendering signal; and an output gamma adjuster configured to adjust the gamma characteristics of the rendering signal to output the data signal.

8. The display apparatus according to claim 7, wherein the renderer is configured to output the rendering signal by calculating the data signals corresponding respectively to the (k−1)-th, k-th, and (k+1)-th pixels, and the resampling filter factors corresponding respectively to the (k−1)-th, k-th, and (k+1)-th pixels.

9. The display apparatus according to claim 8, wherein a ratio of the resampling filter factors corresponding respectively to the (k−1)-th, k-th, and (k+1)-th pixels is 0.25:0.5:0.25.

10. The display apparatus according to claim 7, wherein the renderer comprises:

a resampling filter configured to supply the resampling filter factor; and an arithmetic unit configured to calculate the intermediate data signal and the resampling filter factor.

11. A display apparatus comprising:

a display panel comprising:

a plurality of pixels each for displaying an image corresponding to a data signal, wherein the data signal corresponding to a first pixel of the plurality of pixels comprises first and second color signals and the data signal corresponding to a second pixel of the plurality of pixels comprises third and fourth color signals;

a timing controller configured to:

receive an image signal;

convert the image signal into the data signal to be supplied to the display panel; and generate the data signal, which corresponds to a k-th pixel, on a basis of intermediate data signals corresponding to a (k−1)-th pixel, the k-th pixel, and a (k+1)-th pixel of the plurality of pixels, the timing controller comprising:

a rendering module configured to convert the image signal into the intermediate data signal and to generate the data signal on the basis of the intermediate data signal, the rendering module comprising:

an input gamma adjuster configured to adjust gamma characteristics of the image signal;

a mapping unit configured to map an output signal of the input gamma adjuster into the intermediate data signal;

a renderer configured to calculate the intermediate data signal and a resampling filter factor to output a rendering signal, the renderer comprising:

a first filter configured to supply a first filter factor;

a first arithmetic unit configured to multiply a luminance value by the first filter factor;

a second filter configured to supply a second filter factor;

a second arithmetic unit configured to calculate the intermediate data signal and the second filter factor;

a third filter configured to supply a third filter factor;

a third arithmetic unit configured to calculate the intermediate data signal and the third filter factor;

a first multiplexer configured to output one of output signals from the second and third arithmetic units in response to a first selection signal;

a fourth arithmetic unit configured to calculate output signals of the first and second arithmetic units; and a second multiplexer configured to output one of output signals from the fourth arithmetic unit and the first multiplexer in response to a second selection signal; and an output gamma adjuster configured to adjust the gamma characteristics of the rendering signal to output the data signal;

a backlight controller; and a control signal generator, a gate driver configured to sequentially select the plurality of pixels of the display panel;

a data driver configured to supply an operating voltage, which corresponds to the data signal, to the selected pixel; and a backlight unit configured to supply light to the display panel, wherein the backlight controller is configured to output a backlight control signal for operating the backlight unit on the basis of the intermediate data signal, and wherein the control signal generator is configured to output a first control signal for operating the data driver, and a second control signal for operating the gate driver in response to a control signal supplied from an external source.

12. The display apparatus according to claim 11, wherein the first filter is a sharpening filter, the second filter is a resampling filter, and the third filter is a box filter.

13. The display apparatus according to claim 1, wherein the timing controller further comprises:

a first arithmetic unit configured to multiply a luminance value by the first filter factor;

a second arithmetic unit configured to calculate the intermediate data signal and the second filter factor;

a third arithmetic unit configured to calculate the intermediate data signal and the third filter factor;

a first multiplexer configured to output one of output signals from the second and third arithmetic units in response to a first selection signal;

a fourth arithmetic unit configured to calculate output signals of the first and second arithmetic units; and a second multiplexer configured to output one of output signals from the fourth arithmetic unit and the first multiplexer in response to a second selection signal.

14. The display apparatus according to claim 1, wherein the first filter is a sharpening filter, the second filter is a resampling filter, and the third filter is a box filter.

* * * * *